US011165172B2

(12) United States Patent
Miyamura et al.

(10) Patent No.: US 11,165,172 B2
(45) Date of Patent: Nov. 2, 2021

(54) TERMINAL AND WIRE WITH TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Hajime Kawase, Mie (JP); Masaaki Tabata, Mie (JP); Yasuo Omori, Mie (JP); Teruo Hara, Mie (JP); Shunya Takeuchi, Mie (JP); Hajime Matsui, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/968,928

(22) PCT Filed: Feb. 5, 2019

(86) PCT No.: PCT/JP2019/003954
§ 371 (c)(1),
(2) Date: Aug. 11, 2020

(87) PCT Pub. No.: WO2019/159746
PCT Pub. Date: Aug. 22, 2019

(65) Prior Publication Data

US 2021/0050677 A1 Feb. 18, 2021

(30) Foreign Application Priority Data

Feb. 15, 2018 (JP) ..... JP2018-025418

(51) Int. Cl.
*H01R 4/18* (2006.01)
*H01R 4/48* (2006.01)
*H01R 13/26* (2006.01)

(52) U.S. Cl.
CPC ..... *H01R 4/18* (2013.01); *H01R 4/48* (2013.01); *H01R 13/26* (2013.01)

(58) Field of Classification Search
None
See application file for complete search history.

(56) References Cited

U.S. PATENT DOCUMENTS 3,243,757 A * 3/1966 Cobaugh ..... H01R 4/48 439/442
4,717,361 A 1/1988 Igarashi et al.
(Continued)

FOREIGN PATENT DOCUMENTS

JP 15-000085 1/1940
JP 62-28370 2/1987
(Continued)

OTHER PUBLICATIONS

International Search Report dated Mar. 19, 2019.

*Primary Examiner* — Ross N Gushi
(74) *Attorney, Agent, or Firm* — Gerald E. Hespos; Michael J. Porco; Matthew T. Hespos

(57) ABSTRACT

A female terminal (12) to be connected to an end of a wire (11) is provided with a wire connecting portion (19) including a base (22) and first and second pinching portions (14, 15) extending along an extending direction from the base (22) and configured to pinch the wire (11), and a sliding portion (18) movable along the extending direction and including first pressing portions (16A, 16B) and second pressing portions (17A, 17B) for pressing the first and second pinching portions (14, 15) toward the wire (11) by coming into contact with the first and second pinching portions (14, 15). The first pressing portions (16A, 16B) and the second pressing portions (17A, 17B) project toward the first and second pinching portions (14, 15) and are side by
(Continued)

side at an interval in a direction intersecting the extending direction.

10 Claims, 15 Drawing Sheets

(56) References Cited

U.S. PATENT DOCUMENTS

| | | | |
|---|---|---|---|
| 2002/0119710 | A1 | 8/2002 | Mello et al. |
| 2005/0026515 | A1 | 2/2005 | Hashimoto et al. |
| 2015/0056875 | A1 | 2/2015 | Kobayashi et al. |

FOREIGN PATENT DOCUMENTS

| | | |
|---|---|---|
| JP | 2005-50736 | 2/2005 |
| JP | 2015-56209 | 3/2015 |
| JP | 2017-174595 | 9/2017 |
| WO | 2013/137415 | 9/2013 |

* cited by examiner

TERMINAL AND WIRE WITH TERMINAL

BACKGROUND

Field of the Invention

This specification relates to a terminal and a wire with terminal.

Related Art

Japanese Unexamined Patent Publication No. 2005-50736 discloses a terminal with a crimping portion to be crimped to the core exposed from the end of the wire from outside. The terminal having a predetermined shape is formed by press-working a metal plate material. Subsequently, the terminal is placed on a placing part of a lower mold, and the core exposed from the end of the wire is placed on the crimping portion of the terminal. An upper mold then is moved toward the lower mold so that the crimping portion is pinched between a crimping part of the upper mold and the placing part of the lower mold. Thus, the crimping portion is crimped to the core of the wire.

However, the molds for crimping the crimping portion of the terminal to the core of the wire is necessary according to Japanese Unexamined Patent Publication No. 2005-50736. Thus, there is a problem that facility investment is necessary and manufacturing cost increases.

To solve the above problem, a terminal is considered with two pinching portions for pinching a wire. A core is disposed between the pinching portions of this terminal and a slide with pressing portions is slid for pressing the pinching portions toward the core from a direction in which the wire is drawn out from the terminal. In this way, the pressing portions press the pinching portions toward the core and the pinching portions pinch the core for connecting the terminal and the wire.

However, a considerable pressing force is necessary to reduce contact resistance between the pinching portions of the terminal and the core. Thus, the pinching portions need to be pressed toward the core with a sufficiently large force by the pressing portions of the slide. As a result, it becomes difficult to slide the slide and there has been a concern for a reduction in the efficiency of a connecting operation of the terminal and the wire.

This specification was completed on the basis of the above situation and aims to improve the efficiency of a connecting operation of a terminal and a wire.

SUMMARY

This specification is directed to a terminal to be connected to an end of a wire. The terminal includes a wire connecting portion including a base and a pinching portion extending along an extending direction from the base. The pinching portion is configured for pinching the wire. A sliding portion is movable along the extending direction with respect to the wire connecting portion. The sliding portion includes pressing portions for pressing the pinching portion toward the wire by coming into contact with the pinching portion. The pressing portions project toward the pinching portion and are side by side at an interval in a direction intersecting the extending direction.

Further, this specification is directed to a wire with terminal including the above terminal and a wire connected to the terminal.

According to the above configuration, the tips of the pressing portions respectively contact the pinching portion. In this way, the pressing portions contact the pinching portion at a plurality of distributed positions so that contact areas of the pressing portions and the pinching portion can be reduced. Thus, the sliding portion can be made easily movable in the extending direction, and the efficiency of a connecting operation of the terminal and the wire can be improved.

The pressing portions may extend along the extending direction. Accordingly, the sliding portion can be moved smoothly as compared to the case where the pressing portions are formed discretely along the extending direction. In this way, the efficiency of the connecting operation of the terminal and the wire can be improved.

The wire may be disposed between adjacent pressing portions. According to the above-described configuration, the pinching portion pressed by the pressing portions is deformed along the outer shape of the wire so that a deformation amount of the pinching portion can be suppressed. As a result, a pressing force necessary to deform the pinching portion is reduced, and the sliding portion can be moved easily in the extending direction. As a result, the efficiency of the connecting operation of the terminal and the wire can be improved.

According to this specification, it is possible to improve the efficiency of a connecting operation of a terminal and a wire.

DETAILED DESCRIPTION

One embodiment of this specification is described with reference to FIGS. 1 to 15. A wire with terminal 10 according to this embodiment includes a wire 11 and a female terminal 12 (an example of a terminal) connected to the wire 11. In the following description, a Z direction an upward direction, a Y direction is a forward direction, and an X direction is leftward direction. Further, only some of a plurality of same members may be denoted by a reference sign and the other members may not be denoted by the reference sign.

Wire 11

Figure 1:
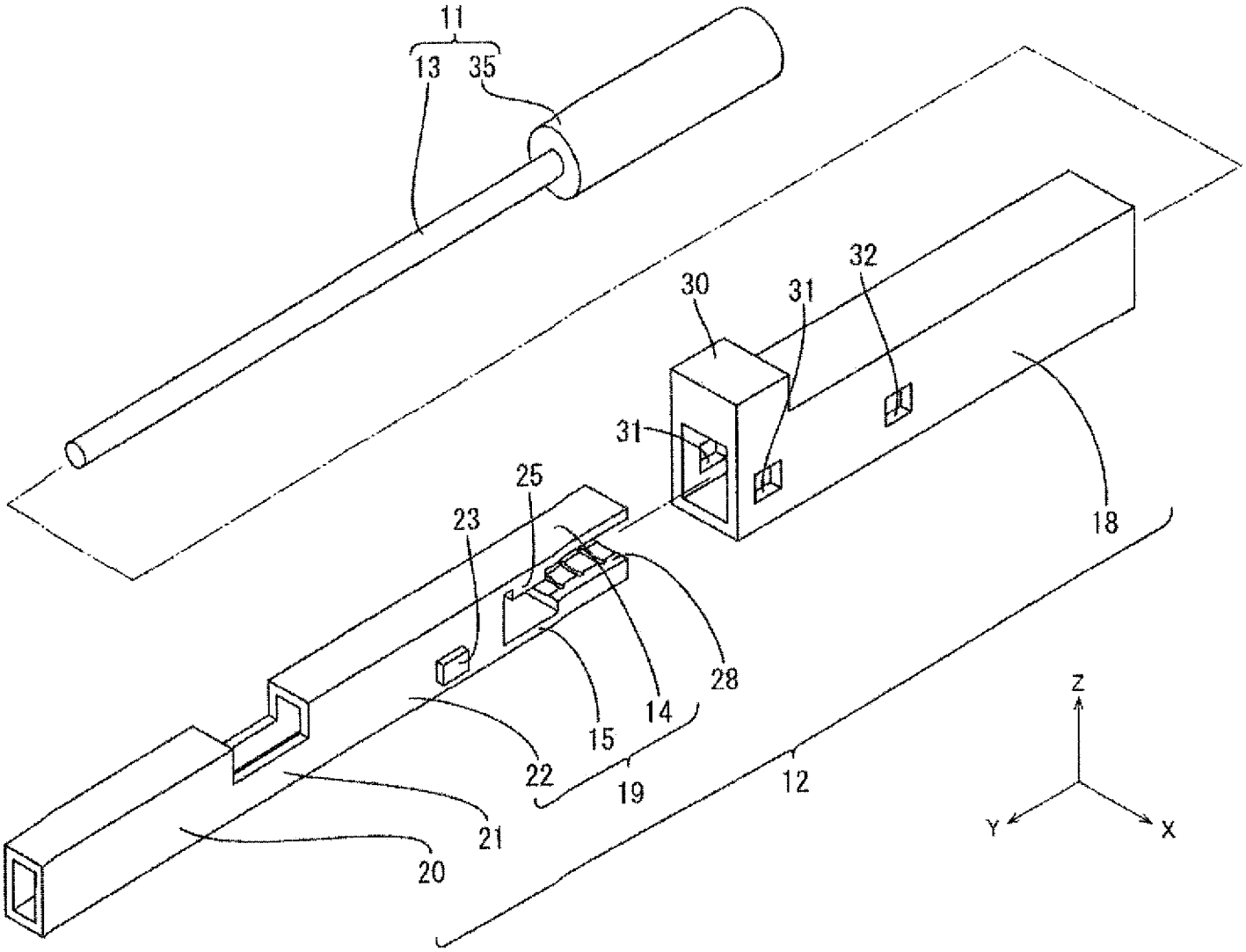
FIG. 1 is an exploded perspective view showing a wire and a female terminal according to one embodiment.

As shown in FIG. 1, the wire 11 includes a core 13 and an insulation coating 35 made of insulating synthetic resin and covering the outer periphery of the core 13. A metal, such as copper, copper alloy, aluminum or aluminum alloy, can be selected as the core 13. The core 13 according to this embodiment is made of copper or copper alloy. The core 13 may be a stranded wire formed by stranding metal strands or may be a single-core wire made of one bar-like metal material. The core 13 according to this embodiment is a single-core wire.

Female Terminal 12

Figure 2:
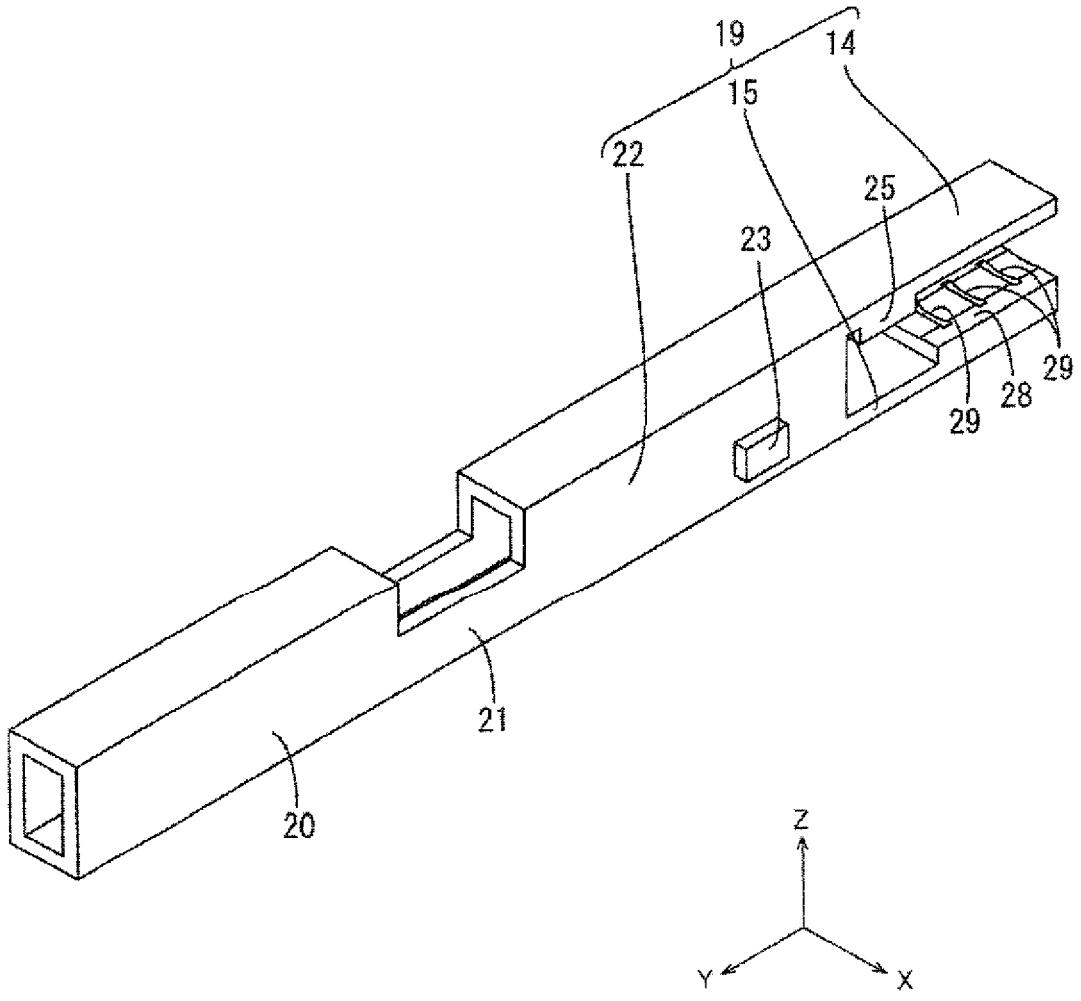
FIG. 2 is a perspective view showing a connecting tube portion, an extending portion and a wire connecting portion of the female terminal.
Figure 3:
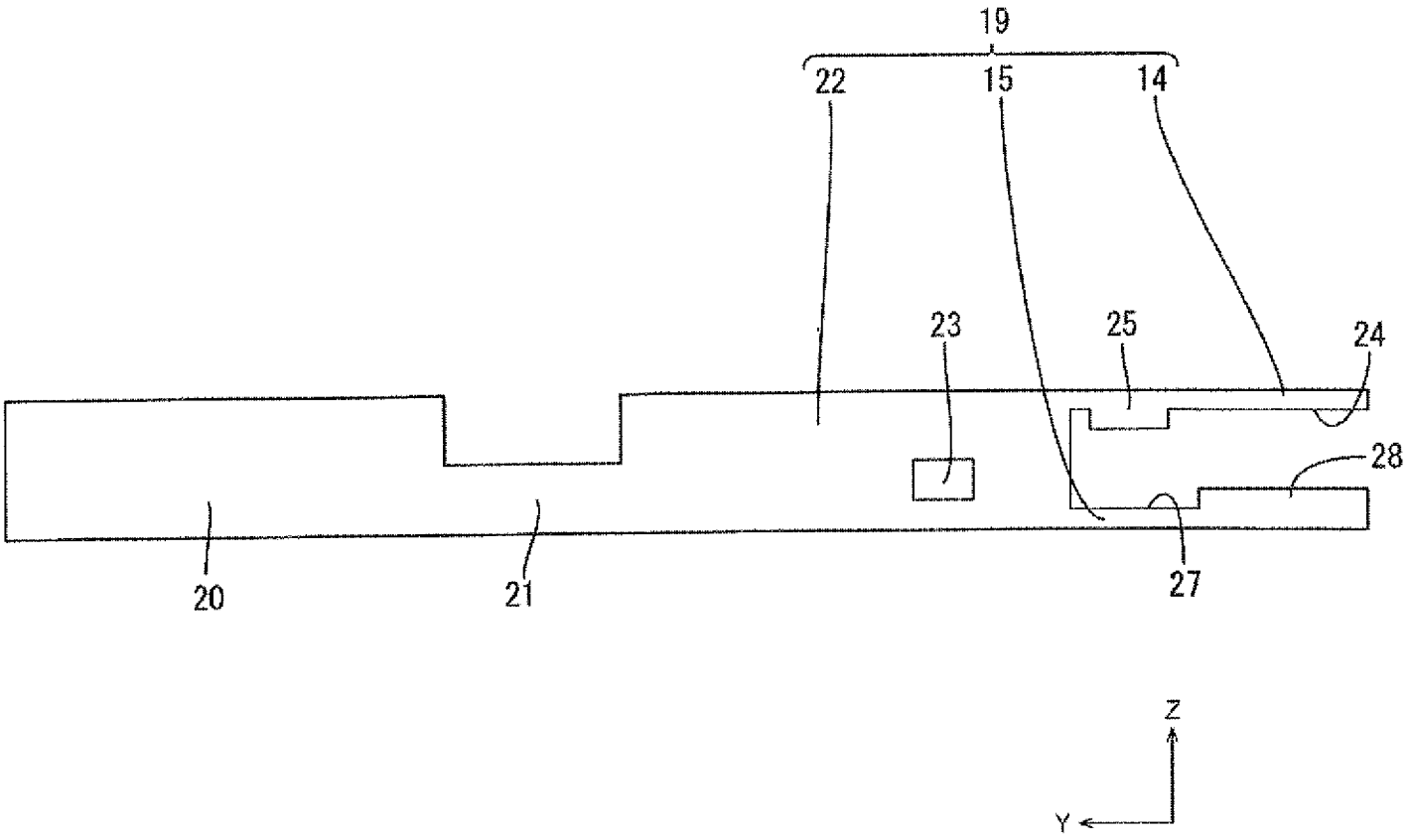
FIG. 3 is a side view showing the connecting tube portion, the extending portion and the wire connecting portion of the female terminal.
Figure 4:
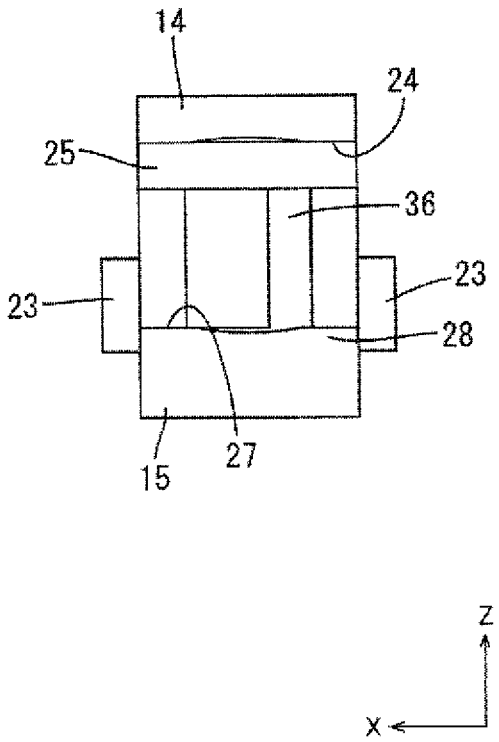
FIG. 4 is a back view showing the connecting tube portion, the extending portion and the wire connecting portion of the female terminal.

As shown in FIGS. 2 to 3, the female terminal 12 is provided with a wire connecting portion 19 including a first pinching portion 14 (an example of a pinching portion) and a second pinching portion 15 (an example of the pinching portion) for pinching the core 13 of the wire 11, and a sliding portion 18 including first pressing portions 16A, 16B (an example of pressing portions) and second pressing portions 17A, 17B (an example of the pressing portions) for pressing the first and second pinching portions 14, 15 toward the core 13.

The female terminal 12 is made of a conductive metal. A metal, such as copper, copper alloy, aluminum or aluminum alloy can be selected as a metal constituting the terminal. The terminal according to this embodiment is made of copper or copper alloy. The female terminal 12 can be formed by a known method such as cutting, casting, press-working or the like.

The female terminal 12 includes a connecting tube 20 into which an unillustrated male terminal is inserted. The connecting tube 20 is in the form of a rectangular tube extending in a front-rear direction and is open forward and rearward. A resilient contact piece (not shown) to be resiliently brought into contact with the male terminal is disposed inside the connecting tube portion 20. By the resilient contact of this resilient contact piece with the male terminal, the male terminal and the female terminal 12 are connected electrically.

An extending portion 21 extends rearward from a rear end of the connecting tube 20, and a wire connecting portion 19 extends rearward from a rear end of this extending portion 21. The wire connecting portion 19 includes a base 22 and first and second pinching portions 14, 15 extending rearward (an example of an extending direction) from a rear end of the base 22.

The extending portion 21 is open upward. In this way, the core 13 disposed inside the extending portion 21 can be confirmed visually from above.

The base 22 is a rectangular tube extending in the front-rear direction and is open forward and rearward. Locking projections 23 project laterally on left and right side walls of the base 22 (see FIG. 4).

Figure 5:
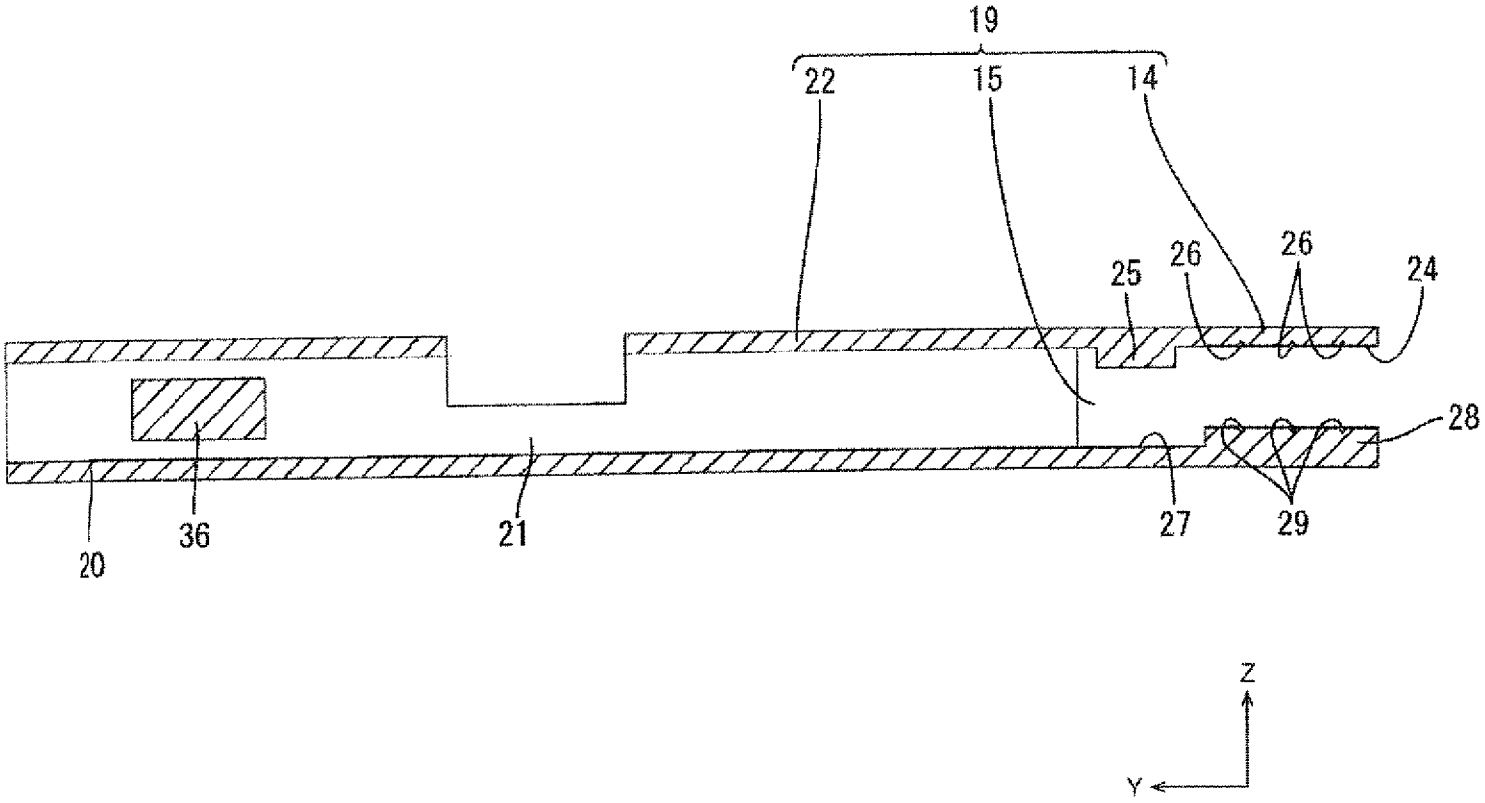
FIG. 5 is a section showing the connecting tube portion, the extending portion and the wire connecting portion of the female terminal.
Figure 6:
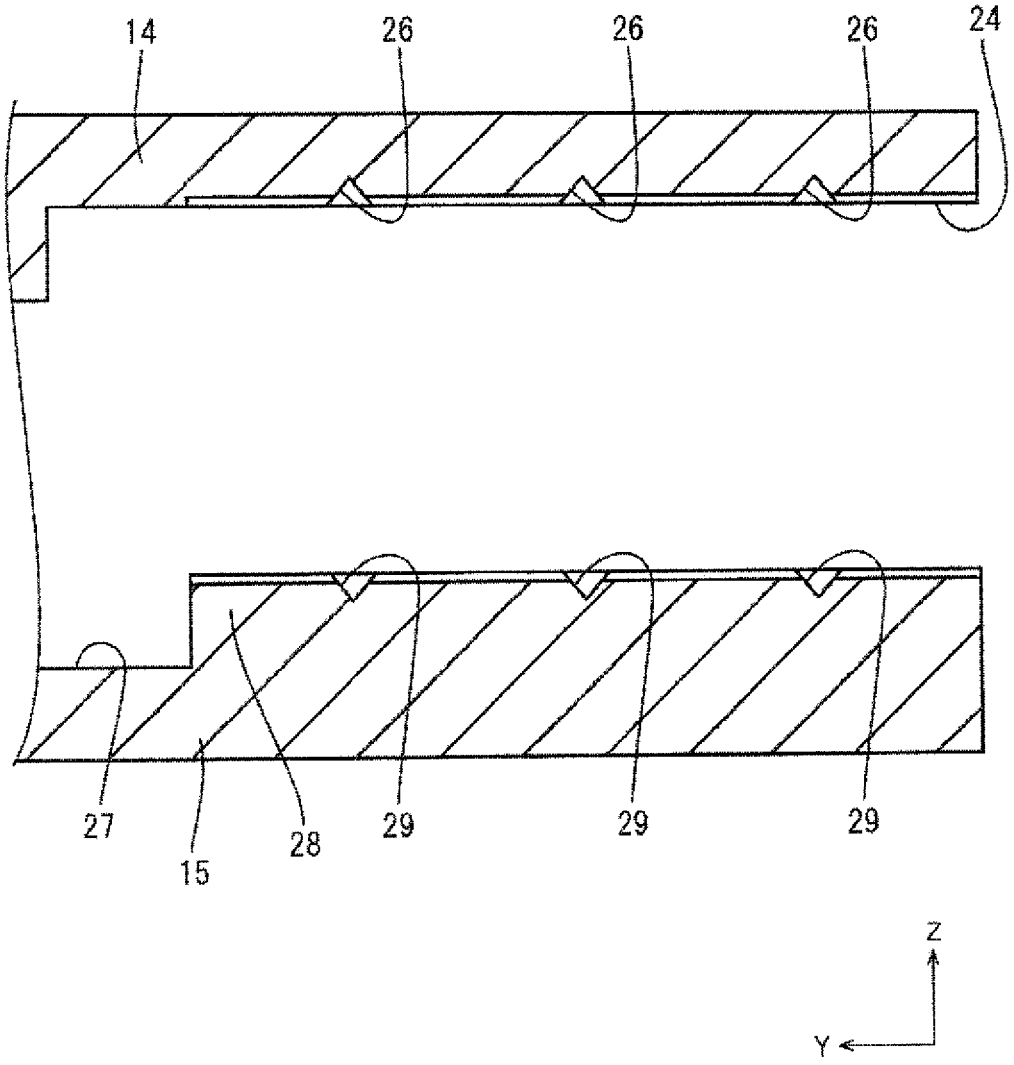
FIG. 6 is a partial enlarged section showing the wire connecting portion.

As shown in FIG. 5, the first pinching portion 14 extends rearward (an example of the extending direction) from a rear end of the upper wall of the base 22. The first pinching portion 14 is a plate elongated in the front-rear direction and is deflectable and deformable in a plate thickness direction (vertical direction). The lower surface of the first pinching portion 14 serves as a first contact surface 24 to be brought into contact with the core 13. A first projection 25 projects down from the first contact surface 24 at a position of the first pinching portion 14 near a front end. First serrations 26 extend laterally at intervals in the front-rear direction. The first serrations 26 are V-shaped grooves formed at positions behind the first projection 25 in the first contact surface 24 of the first pinching portion 14 (see FIG. 6).

As shown in FIG. 5, the second pinching portion 15 extends rearward (an example of the extending direction) from a rear end of the lower wall of the base 22. The second pinching portion 15 is a plate elongated in the front-rear direction and is deflectable and deformable in a plate thickness direction (vertical direction). The upper surface of the second pinching portion 15 serves as a second contact surface 27 to be brought into contact with the core 13. A second projection 28 projects up from the second contact surface 27 at a position behind a rear end part of the first projection of the first pinching portion 14 on the second contact surface 27 of the second pinching portion 15. Second serrations 29 extend laterally at intervals in the front-rear direction. The second serrations 29 are V-shaped grooves formed in the upper surface of the second projection 28 (see FIG. 6).

Sliding Portion 18

Figure 7:
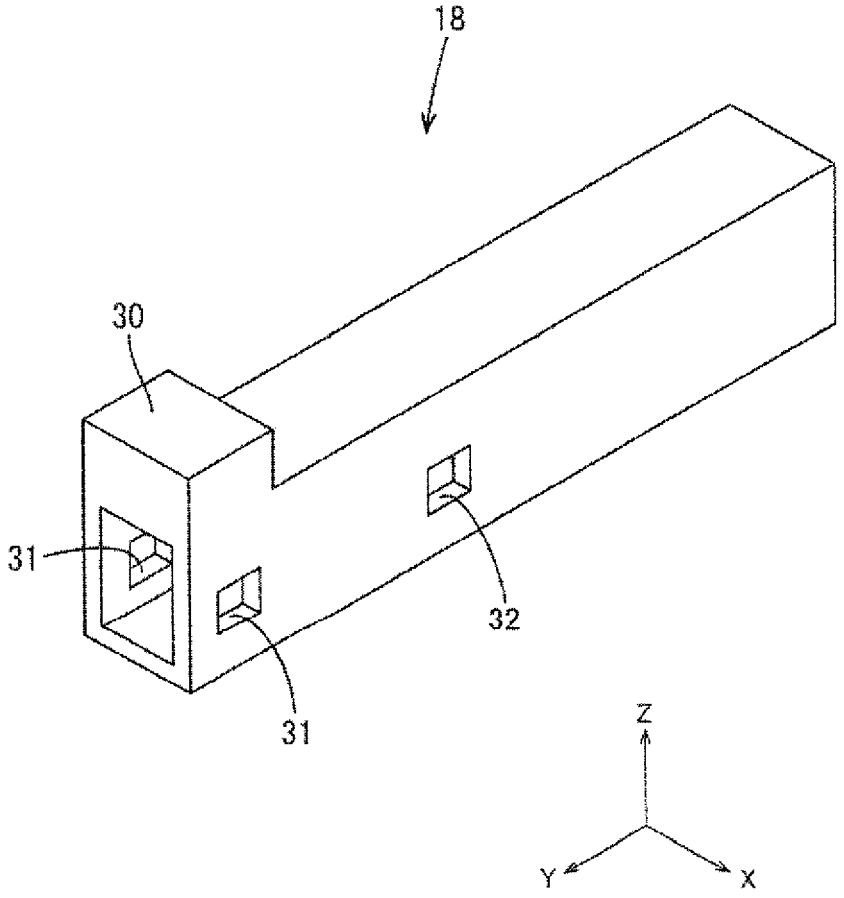
FIG. 7 is a perspective view showing a sliding portion.

As shown in FIG. 7, the sliding portion 18 is a rectangular tube elongated in the front-rear direction and open forward and rearward. A front opening of the sliding portion 18 has an outer shape equal to or somewhat larger than that of the wire connecting portion 19, so that the wire connecting portion 19 can be inserted. The sliding portion 18 can be made of an arbitrary material, such as metal, synthetic resin or ceramic. An arbitrary metal, such as copper, copper alloy, aluminum, aluminum alloy or stainless steel, can be selected as a metal constituting the sliding portion 18. If the sliding portion 18 is made of metal, the sliding portion 18 can be formed by an arbitrary method, such as cutting, casting or press-working.

A jig contact portion 30 projects up on a front end of the upper wall of the sliding portion 18. This jig contact portion 30 is pressed from behind by a jig 34 to slide the sliding portion 18 forward.

Partial locking holes 31 are provided at positions near front end parts of left and right side walls of the sliding portion 18. The partial locking holes 31 penetrate through the left and right side walls of the sliding portion 18 and are locked to the locking projections 23 for holding the sliding portion 18 at a partial locking position with respect to the wire connecting portion 19. The size of each partial locking hole 31 is equal to or somewhat larger than the locking projection 23, so that the locking projection 23 can fit into the respective partial locking hole 31.

Full locking holes 32 are provided behind the partial locking holes 31 in the left and right side walls of the sliding portion 18. The full locking holes 32 penetrate through the left and right side walls of the sliding portion 18 and are to the locking projections 23 for holding the sliding portion 18 at a full locking position with respect to the wire connecting portion 19. The size of each full locking hole 32 is equal to or somewhat larger than the locking projection 23, so that the locking projection 23 can fit into the full locking hole 32.

Figure 8:
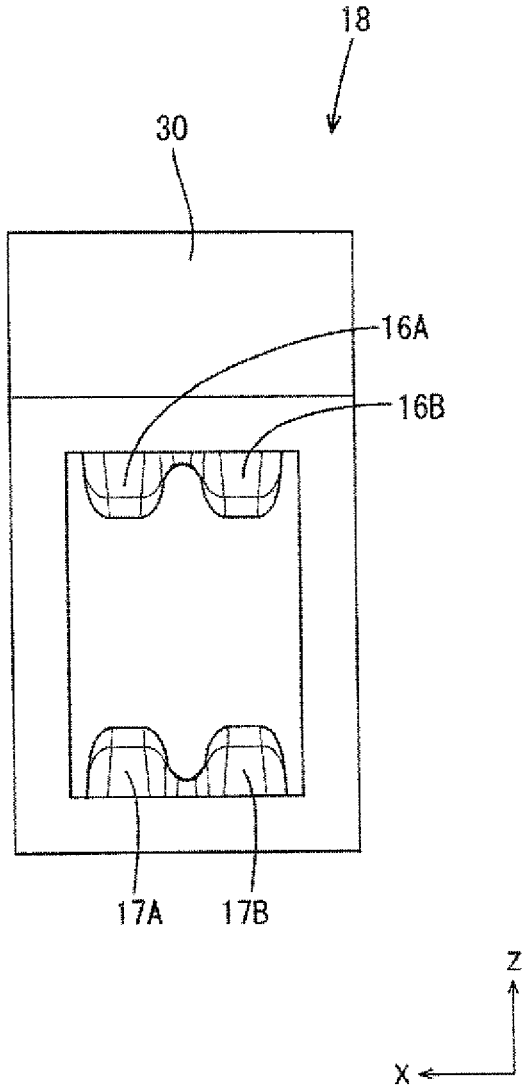
FIG. 8 is a back view showing the sliding portion.

As shown in FIG. 8, first pressing portions 16A, 16B project down on the lower surface of the upper wall of the sliding portion 18 to extend in the front-rear direction at a position behind a center position in the front-rear direction. Rear end parts of the first pressing portions 16A, 16B extend up to a position somewhat in front of a rear end part of the sliding portion 18. The first pressing portions 16A, 16B are arranged at an interval in the lateral direction. Projecting dimensions of the two first pressing portions 16A, 16B from the upper wall of the sliding portion 18 are equal.

Second pressing portions 17A, 17B project up on the upper surface of the lower wall of the sliding portion 18 to extend in the front-rear direction at a position behind a center position in the front-rear direction. Rear end parts of the second pressing portions 17A, 17B extend up to a position somewhat in front of the rear end part of the sliding portion 18. The two second pressing portions 17A, 17B are arranged at an interval in the lateral direction. Projecting dimensions of the two second pressing portions 17A, 17B from the lower wall of the sliding portion 18 are equal.

A lower end part of the first pressing portion 16A, 16B has a rectangular shape with a rounded ridge part when viewed from behind. Thus, a lateral width of the lower end part of the first pressing portion 16A, 16B is smaller than that of an upper end part of the first pressing portion 16A, 16B. As a result, a contact area between the first pressing portion 16A, 16B and the first pinching portion 14 is smaller as compared to the case where the ridge part is not rounded.

An upper end part of the second pressing portion 17A, 17B has a rectangular shape with a rounded ridge part when viewed from behind. Thus, a lateral width of an upper end part of the second pressing portion 17A, 17B is smaller than that of a lower end part of the second pressing portion 17A, 17B. As a result, a contact area between the second pressing portion 17A, 17B and the second pinching portion 15 is smaller as compared to the case where the ridge part is not rounded.

Partially Locked State

Figure 9:
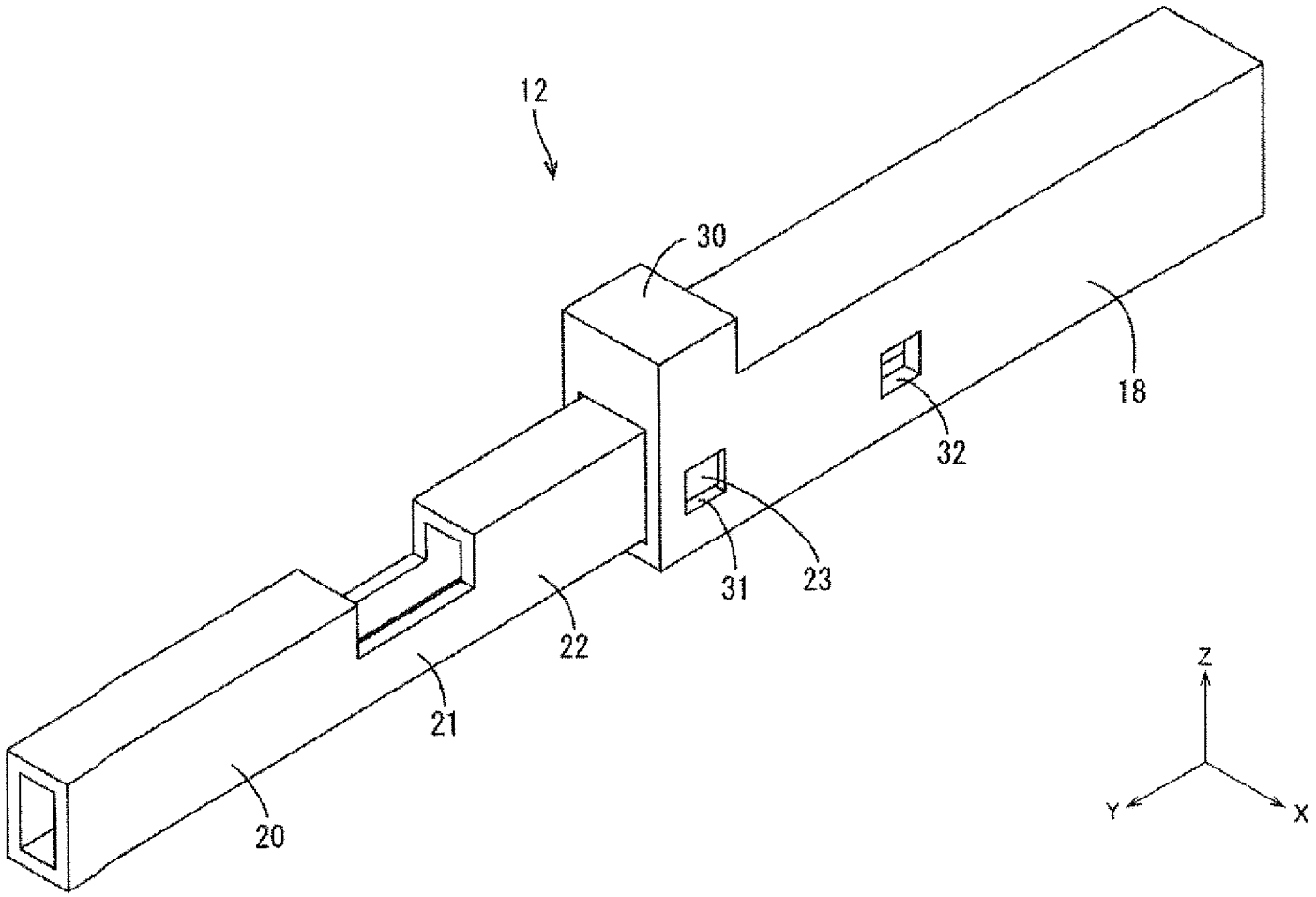
FIG. 9 is a perspective view showing a state where the sliding portion is partially locked.
Figure 10:
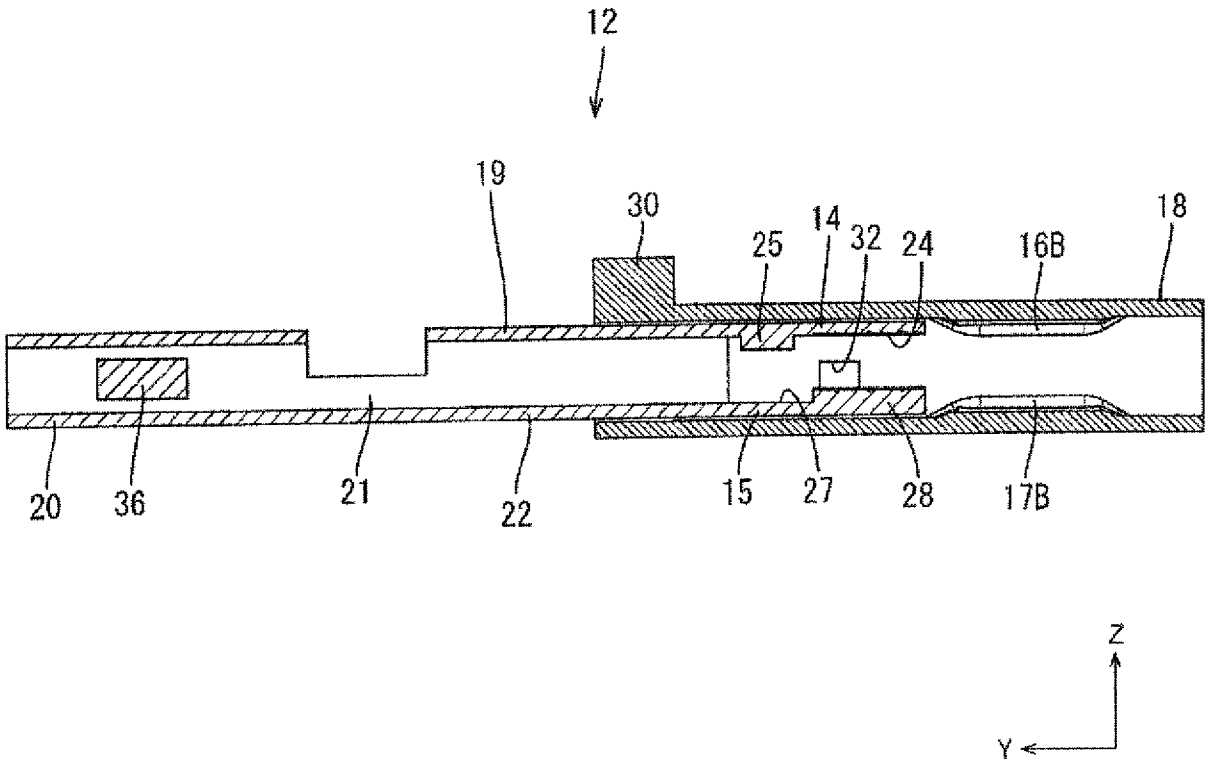
FIG. 10 is a section showing the state where the sliding portion is partially locked.
Figure 11:
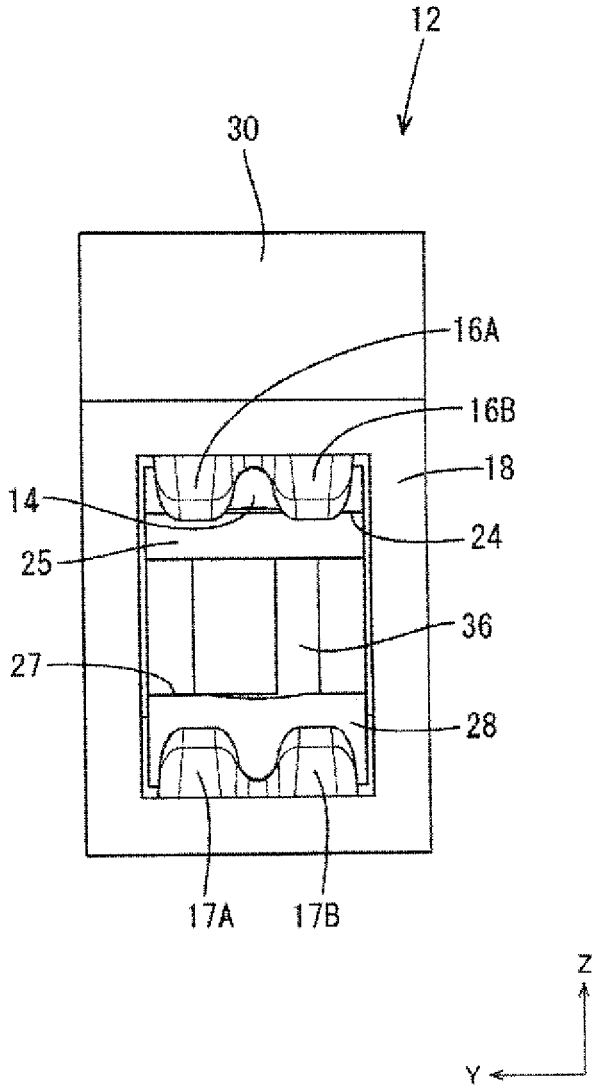
FIG. 11 is a back view showing the state where the sliding portion is partially locked.

FIGS. 9 to 11 show a state where the sliding portion 18 is partially locked to the wire connecting portion 19. The locking projections 23 of the wire connecting portion 19 are fit in the partial locking portions 31 of the sliding portion 18. With the sliding portion 18 held at the partial locking position with respect to the wire connecting portion 19, a front half of the sliding portion 18 is fit externally to a part of the wire connecting portion 19 substantially over a two-thirds length from a rear end part in the front-rear direction.

As shown in FIG. 10, in a partially locked state, a rear end part of the first pinching portion 14 is located in front of front ends of the first pressing portions 16A, 16B. A rear end part of the second pinching portion 15 is located in front of front ends of the second pressing portions 17A, 17B. In other words, in the partially locked state, the first pinching portion 14 and the first pressing portions 16A, 16B are not in contact and the second pinching portion 15 and the second pressing portions 17A, 17B are not in contact.

As shown in FIG. 11, the first and second pinching portions 14, 15 are exposed from a rear opening of the sliding portion 18. The core 13 is inserted into a space between the first and second pinching portions 14, 15.

Fully Locked State

Figure 13:
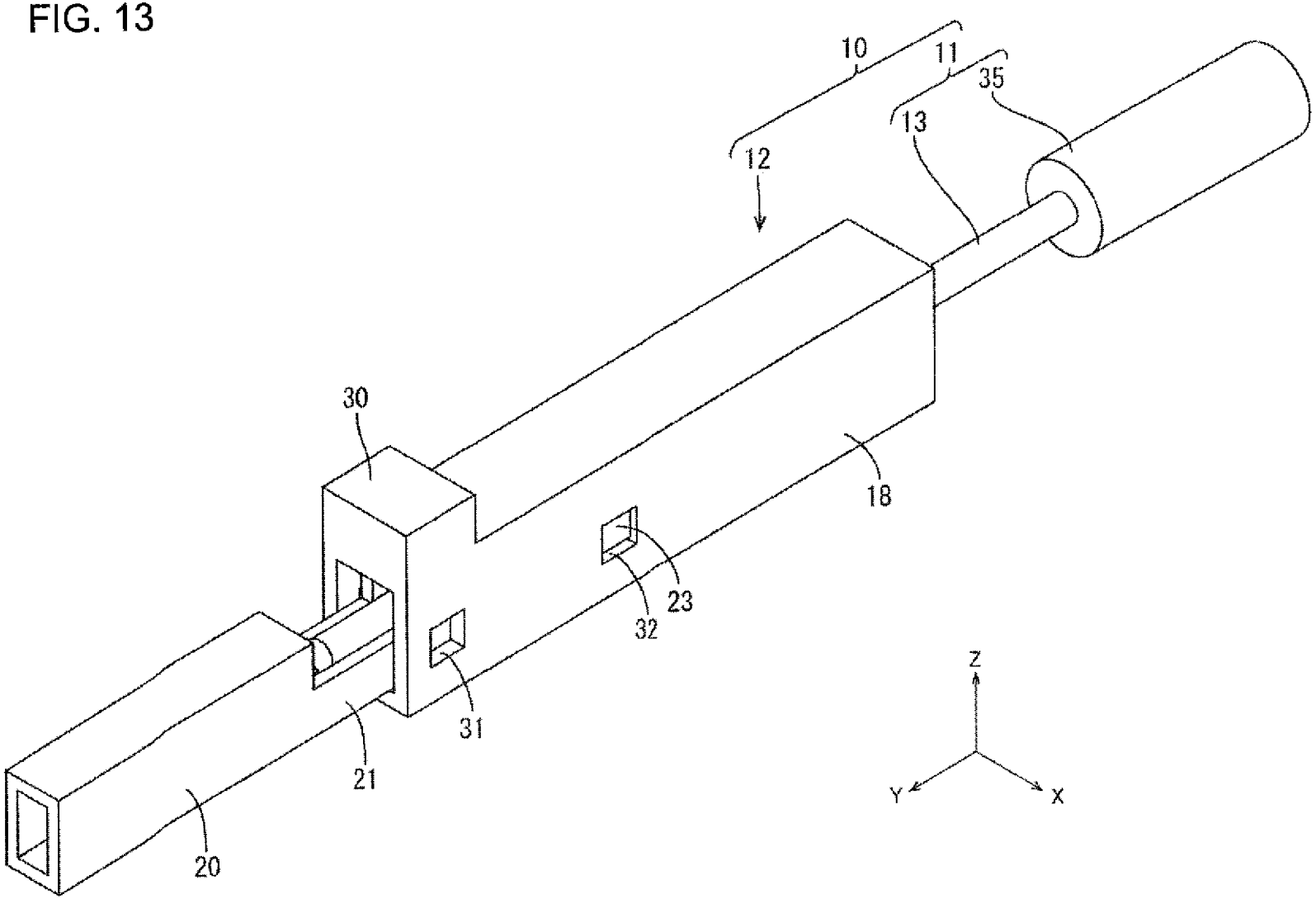
FIG. 13 is a perspective view showing a wire with terminal.
Figure 14:
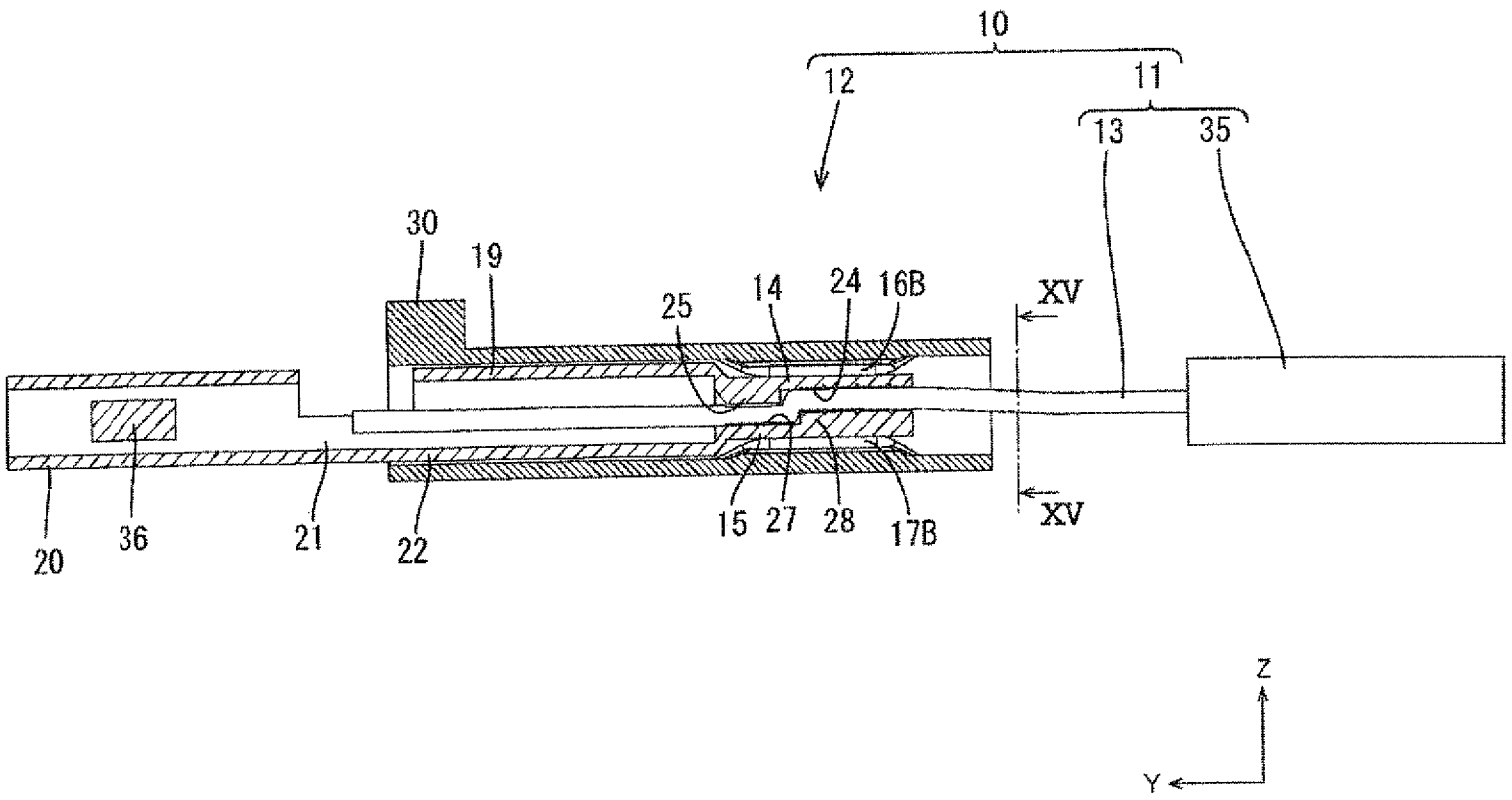
FIG. 14 is a section showing the wire with terminal.
Figure 15:
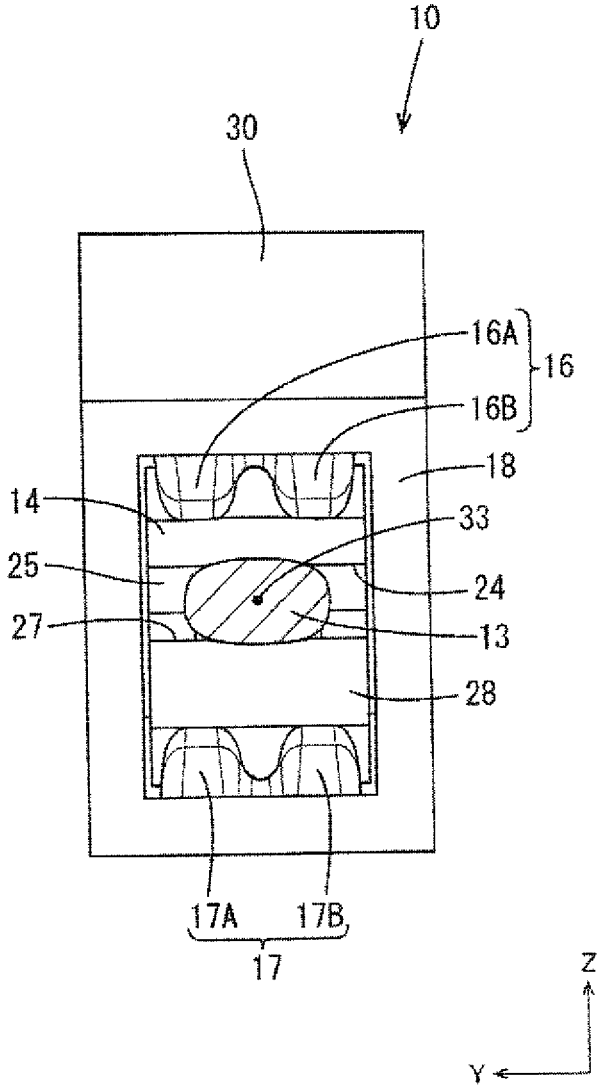
FIG. 15 is a section along XV-XV in FIG. 14.

FIGS. 13 to 15 show a state where the sliding portion 18 is fully locked to the wire connecting portion 19. The locking projections 23 of the wire connecting portion 19 are fit in the full locking portions 32 of the sliding portion 18. With the sliding portion 18 held at the full locking position with respect to the wire connecting portion 19, the sliding portion 18 completely covers the wire connecting portion 19 in the front-rear direction. The front part of the sliding portion 18 is located in front of a front end of the wire connecting portion 19, and the rear part of the sliding portion 18 is located behind the rear end of the wire connecting portion 19.

As shown in FIG. 14, the first pressing portions 16A, 16B are in contact with the upper surface (surface opposite to the first contact surface 24) of the first pinching portion 14 from above. In this way, the first pinching portion 14 is bent down to contact the core 13 from above.

The second pressing portions 17A, 17B are in contact with the lower surface (surface opposite to the second contact surface 27) of the second pinching portion 15 from below. In this way, the second pinching portion 15 is bent up to contact the core 13 from below.

The first pinching portion 14 is pressed from above by the first pressing portions 16A, 16B and the second pinching portion 15 is pressed from below by the second pressing portions 17A, 17B. Thus, the core 13 disposed between the first and second pinching portions 14, 15 is pinched by the first and second pinching portions 14, 15 so that the wire 11 and the female terminal 12 are connected electrically. The core 13 is pressed and pinched vertically, thereby being deformed into an elliptical shape flat in the vertical direction (see FIG. 15).

As shown in FIG. 14, the core 13 is pinched between the first projection 25 of the first pinching portion 14 and the second projection 28 of the second pinching portion, which are shifted in the front-rear direction, thereby being bent into a crank shape. In this way, the core 13 is held firmly between the first and second pinching portions 14, 15.

The first contact surface 24 of the first pinching portion 14 is pressed against the core 13 so that the core 13 is fit into the first serrations 26 formed in the first contact surface 24. In this way, an oxide film formed on a surface of the core 13 is peeled to expose a metal surface. Electrical resistance between the first pinching portion 14 and the core 13 can be reduced by the contact of the exposed metal surface and the first contact surface 24.

Similarly, the second contact surface 27 of the second pinching portion 15 is pressed against the core 13 so that the core 13 is fit into the second serrations 29 formed in the second contact surface 27. In this way, the oxide film formed on the surface of the core 13 is peeled to expose a metal surface. Electrical resistance between the second pinching portion 15 and the core 13 can be reduced by the contact of the exposed metal surface and the second contact surface 27.

As shown in FIG. 15, an axial center 33 of the core 13 is located between the two first pressing portions 16A, 16B arranged in the lateral direction and between the two second pressing portions 17A, 17B arranged in the lateral direction when viewed from behind.

Example of Connection Process of Female Terminal 12 and Wire 11

Next, an example of a connection process of the female terminal 12 and the wire 11 according to this embodiment is described. Note that the connection process of the female terminal 12 and the wire 11 is not limited to the one described below.

First, the sliding portion 18 is fit externally to the wire connecting portion 19 of the female terminal 12 from behind. The rear end part of the wire connecting portion 19 of the female terminal 12 is inserted into the front opening of the sliding portion 18 and the sliding portion 18 is moved forward. When the locking projections 23 of the wire connecting portion 19 come into contact with the front opening edge of the sliding portion 18 from the front, the left and right side walls of the wire connecting portion 19 are deformed resiliently inward in the lateral direction. When the sliding portion 18 is moved farther forward, the locking projections 23 are fit into the partial locking holes 31 and the left and right side walls of the wire connecting portion 19 are restored. In this way, the locking projections 23 contact the edges of the partial locking holes 31 from the front or behind to hold the sliding portion 18 at the partial locking position with respect to the wire connecting portion 19 (see FIGS. 9 to 11).

Subsequently, the insulation coating 35 is stripped on the end of the wire 11 to expose the core 13. The exposed core 13 is inserted through the rear opening of the sliding portion 18. The core 13 is inserted farther forward to locate a front end part of the core 13 in the extending portion 21. By visually confirming the extending portion 21 from above, it can be confirmed that the front part of the core 13 is located inside the extending portion 21 (see FIG. 12).

Figure 12:
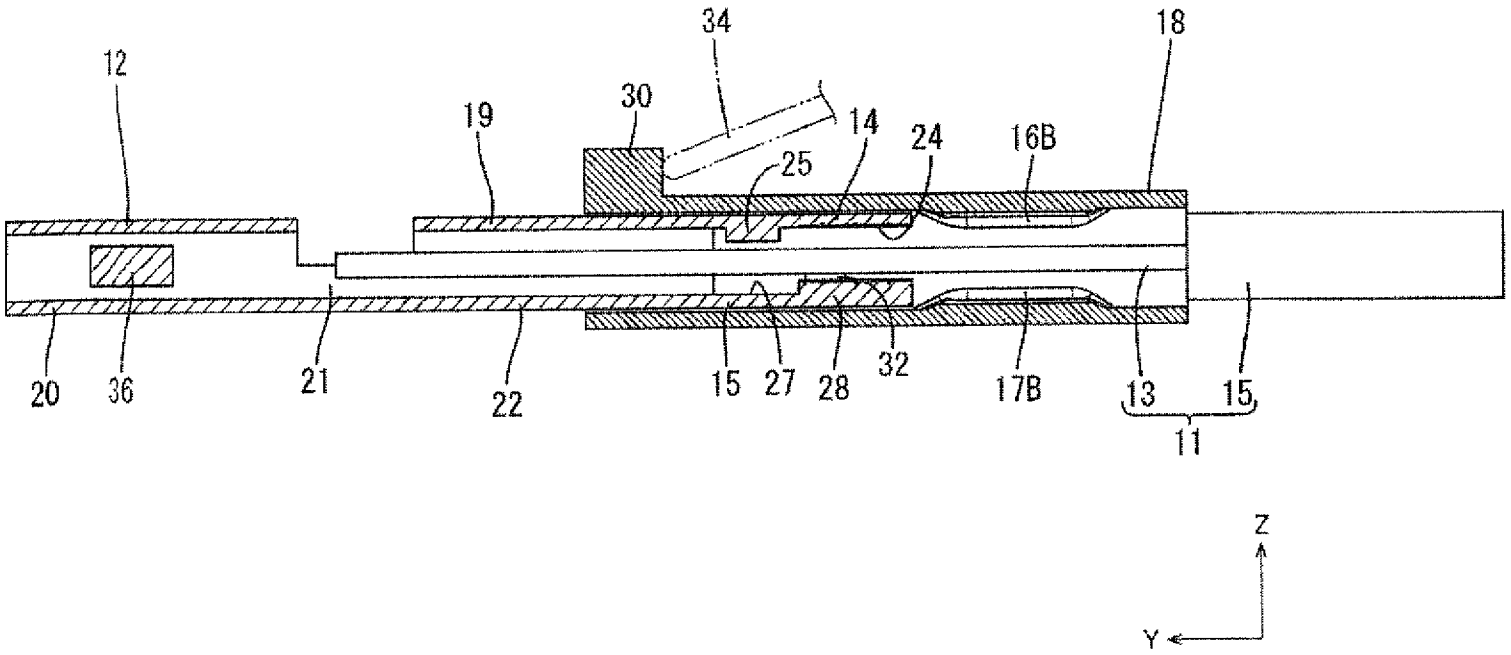
FIG. 12 is a section showing a state where a core is inserted with the sliding portion partially locked.

As shown in FIG. 12, the jig 34 is brought into contact with the jig contact portion 30 from behind to press the jig contact portion 30 from behind, thereby causing the sliding portion 18 to be moved forward. Then, the left and right side walls of the sliding portion 18 ride onto the locking projections 23 of the wire connecting portion 19. In this way, the left and right side walls of the wire connecting portion 19 are deformed resiliently inwardly in the lateral direction. When the sliding portion 18 is moved farther forward, the first pressing portions 16A, 16B come into contact with the upper surface of the first pinching portion 14 from above and the second pinching portions 17A, 17B come into contact with the lower surface of the second pinching portion 15 from below.

By moving the sliding portion 18 farther forward, the first pressing portions 16A, 16B press the first pinching portion 14 down from above and the second pressing portions 17A, 17B press the second pinching portion 15 up from below. In this way, the first pinching portion 14 is deformed down and the second pinching portion 15 is deformed up so that the core 13 is pinched by the first and second pinching portions 14, 15.

When the sliding portion 18 is moved farther forward, the locking projections 23 are fit into the full locking holes 32 and the left and right side walls of the wire connecting portion 19 are restored. In this way, the locking projections 23 contact the edges of the full locking holes 32 from front or behind so that the sliding portion 18 is held at the full locking position with respect to the wire connecting portion 19 (see FIGS. 14 and 15). In this way, a connecting operation of the female terminal 12 and the wire 11 is finished to complete the wire with terminal 10.

Functions and Effects of Embodiment

Next, functions and effects of this embodiment are described. The female terminal 12 according to this embodiment is to be connected to the end of the wire 11 and is provided with the wire connecting portion 19 including the base 22 and the first and second pinching portions 14, 15 extending along the extending direction from the base 22 and configured to pinch the wire 11. The sliding portion 18 is movable along the extending direction and includes the first pressing portions 16A, 16B and the second pressing portions 17A, 17B for pressing the first and second pinching portions 14, 15 toward the wire 11 by coming into contact with the first and second pinching portions 14, 15. The first pressing portions 16A, 16B and the second pressing portions 17A, 17B project toward the first and second pinching portions 14, 15 and are side by side at an interval in a direction intersecting the extending direction.

Further, in the wire with terminal 10 according to this embodiment, the female terminal 12 is connected to the end part of the wire 11.

According to the above configuration, the tips of the first pressing portions 16A, 16B and the second pressing portions 17A, 17B respectively contact the first and second pinching portions 14, 15. In this way, the first pressing portions 16A, 16B and the second pressing portions 17A, 17B contact the first and second pinching portions 14, 15 at a plurality of distributed positions. Therefore contact areas of the first pressing portions 16A, 16B and the second pressing portions 17A, 17B with the first and second pinching portions 14, 15 can be reduced. As a result, the sliding portion 18 easily is movable forward so that the efficiency of the connecting operation of the female terminal 12 and the wire 11 can be improved.

Further, the first pressing portions 16A, 16B and the second pressing portions 17A, 17B extend along the front-rear direction. In this way, the sliding portion 18 can be moved smoothly as compared to the case where the first pressing portions 16A, 16B and the second pressing portions 17A, 17B are formed discretely along the front-rear direction. In this way, the efficiency of the connecting operation of the female terminal 12 and the wire 11 can be improved.

Further, the axial center 33 of the wire 11 is located between the two adjacent first pressing portions 16A, 16B. Further, the axial center 33 of the wire 11 is located between the two adjacent second pressing portions 17A, 17B. In this way, the first pinching portion 14 pressed by the two first pressing portions 16A, 16B and the second pinching portion 15 pressed by the two second pressing portions 17A, 17B are deformed along the outer shape of the wire 11, wherefore deformation amounts of the first and second pinching portions 14, 15 can be suppressed. Since a pressing force necessary to deform the first and second pinching portions 14, 15 is reduced as a result, the sliding portion 18 can be easily moved forward. As a result, the efficiency of the connecting operation of the female terminal 12 and the wire 11 can be improved.

The invention is not limited to the above described and illustrated embodiment. For example, the following embodiments also are included in the scope of the invention.

Although the female terminal 12 includes the first and second pinching portions 14, 15 in the above embodiment, there is no limitation to this. One, three or more pinching portions may be provided.

Although the two first pressing portions 16A, 16B and the two second pressing portions 17A, 17B are formed side by side at an interval in the lateral direction in the above embodiment, there is no limitation to this. Three or more pressing portions may be formed side by side at intervals in the lateral direction.

Although the terminal according to the above embodiment is the female terminal 12, there is no limitation to this. The terminal may be a male terminal or a splice terminal.

Although the outer periphery of the core 13 is covered by the insulation coating 35 in the wire 11 according to the above embodiment, there is no limitation to this. The wire 11 may be a bare wire. Further, the core 13 may be a stranded wire.

Pressing portions may be discretely formed side by side along the extending direction.

Although the base portion 22 has a rectangular tube shape in the above embodiment, there is no limitation to this. The base 22 may have a circular tube shape or a polygonal tube shape such as a triangular tube shape. Further, the sliding portion 18 may also have a circular tube shape or a polygonal tube shape such as a triangular tube shape.

The first pressing portions 16A, 16B and the second pressing portions 17A, 17B can have an arbitrary shape appropriately selected from a triangular shape, a semicircular shape, an elliptical shape and the like when viewed from behind if necessary.

LIST OF REFERENCE SIGNS

10: wire with terminal
11: wire
12: female terminal
14: first pinching portion
15: second pinching portion
16A, 16B: first pressing portion
17A, 17B: second pressing portion
18: sliding portion
19: wire connecting portion
22: base

The invention claimed is:

1. A terminal to be connected to an end of a wire, comprising:

a wire connecting portion including a tubular base and first and second pinching portions opposed to one another and extending along an extending direction from an end of the tubular base, the first and second pinching portions pinching the wire from opposite sides; and a tubular sliding portion movable along the extending direction with respect to the wire connecting portion so that the tubular sliding portion slides over the pinching portions, the tubular sliding portion including two first pressing portions projecting toward the first pinching portion and pressing the first pinching portion toward the wire by coming into contact with the first pinching portion and two second pressing portions projecting toward the second pinching portion and pressing the second pinching portion toward the wire by coming into contact with the second pinching portion, the two first pressing portions being formed side by side at an interval in a direction intersecting the extending direction and the two second pressing portions being formed side by side at an interval in the direction intersecting the extending direction.

2. The terminal of claim 1, wherein the pressing portions are formed to extend along the extending direction.

3. The terminal of claim 1, wherein surfaces of the pinching portions that face one another are formed with serrations.

4. The terminal of claim 1, wherein the base of the wire connecting portion has locking projections extending outward thereon, and the tubular sliding portion has locking holes disposed and configured for locking the tubular sliding portion to the wire connecting portion.

5. The terminal of claim 1, further comprising a jig contact projection projecting out on the tubular sliding portion for receiving a pushing forces on the tubular sliding portion toward the wire connecting portion.

6. A wire with terminal, comprising:

a wire connecting portion including a base and first and second pinching portions opposed to one another and extending along an extending direction from the base;

a wire inserted into the wire connecting portion at a position between the first and second pinching portions so that the first and second pinching portions pinch the wire from opposite sides; and a sliding portion movable along the extending direction with respect to the wire connecting portion, the sliding portion including two first pressing portions projecting toward the first pinching portion and pressing the first pinching portion toward the wire by coming into contact with the first pinching portion and two second pressing portions projecting toward the second pinching portion and pressing the second pinching portion toward the wire by coming into contact with the second pinching portion, the two first pressing portions being formed side by side at an interval in a direction intersecting the extending direction and the two second pressing portions being formed side by side at an interval in the direction intersecting the extending direction, and the pressing portions being offset laterally from a center of the wire.

7. The terminal with wire of claim 6, wherein the pressing portions are formed to extend along the extending direction.

8. The terminal with wire of claim 6, wherein surfaces of the pinching portions that face one another are formed with serrations.

9. The terminal with wire of claim 6, wherein the base of the wire connecting portion has locking projections extending outward thereon, and the tubular sliding portion has locking holes disposed and configured for locking the tubular sliding portion to the wire connecting portion.

10. The terminal with wire of claim 6, further comprising a jig contact projection projecting out on the tubular sliding portion for receiving a pushing forces on the tubular sliding portion toward the wire connecting portion.

* * * * *